US009943178B2

(12) United States Patent
Savinskiy et al.

(10) Patent No.: US 9,943,178 B2
(45) Date of Patent: Apr. 17, 2018

(54) FOOD PREPARATION TABLE

(71) Applicant: ILLINOIS TOOL WORKS INC., Glenview, IL (US)

(72) Inventors: Yevgeniy Savinskiy, Haslet, TX (US); Christopher A. Henderson, Euless, TX (US); Sasenka Kukolj, Keller, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 143 days.

(21) Appl. No.: 15/063,739

(22) Filed: Mar. 8, 2016

(65) Prior Publication Data

US 2016/0345753 A1 Dec. 1, 2016

Related U.S. Application Data

(60) Provisional application No. 62/168,966, filed on Jun. 1, 2015.

(51) Int. Cl.
*A47B 85/00* (2006.01)
*A47F 10/06* (2006.01)
(Continued)

(52) U.S. Cl.
CPC ..... *A47F 10/06* (2013.01); *A47B 77/022* (2013.01); *A47B 96/18* (2013.01); *A47F 3/0491* (2013.01); *A47F 3/06* (2013.01)

(58) Field of Classification Search
CPC ..... A47B 77/022; A47B 77/18; A47B 77/14; A47B 77/16; A47B 2077/027; A47B 96/18; A47B 87/00; A47B 87/0261; A47B 87/007; A47B 47/0091; A47B 31/00; A47B 31/02; A47B 2031/002; A47B 2031/003; A47B 2031/005; A47B 2031/007; A47F 10/00; A47F 10/02; A47F 10/06; A47F 3/063; A47F 3/06; A47F 3/0491; A47F 3/0408; A47F 3/0439; A47F 3/14; A47F 3/147; F25D 2400/08; F25D 2400/10; A47J 37/0704; A47J 37/0731; F24C 15/108; F24C 15/12; F24C 15/14
See application file for complete search history.

(56) References Cited

U.S. PATENT DOCUMENTS 1,169,168 A * 1/1916 Lane et al. ..... A47J 37/0704 126/339
1,650,634 A * 11/1927 Lutzler ..... A47J 37/10 126/41 R
(Continued)

OTHER PUBLICATIONS

PCT, International Search Report and Written Opinion, International Application No. PCT/US2016/033744; dated Jul. 29, 2016, 15 pages.
(Continued)

*Primary Examiner* — Daniel J Troy
*Assistant Examiner* — Andres F Gallego
(74) *Attorney, Agent, or Firm* — Thompson Hine LLP

(57) ABSTRACT

A food preparation table includes a food item catchment system including a modular grate and catch pan arrangement positioned atop an upwardly facing surface of the table and including multiple catch pans, multiple frames and multiple grates, each of which is removable for cleaning of the upwardly facing surface and for cleaning of the catch pans, frames and grates.

12 Claims, 9 Drawing Sheets

(51) Int. Cl.

| | |
|---|---|
| ***A47B 77/02*** | (2006.01) |
| ***A47B 96/18*** | (2006.01) |
| ***A47F 3/04*** | (2006.01) |
| ***A47F 3/06*** | (2006.01) |

(56) References Cited

U.S. PATENT DOCUMENTS 1,821,303 A * 9/1931 Hamilton, Jr. ..... A47B 71/00 108/24
2,006,385 A * 7/1935 Dikeman ..... F24C 15/16 126/339
2,886,395 A * 5/1959 Cahn ..... A47F 10/06 312/229
3,306,280 A * 2/1967 Vannoy ..... A47J 37/0704 126/25 R
3,578,148 A * 5/1971 Pinckard ..... A47F 10/06 186/44
3,874,479 A * 4/1975 Onori ..... A47F 10/06 186/44
D254,281 S 2/1980 Kayfes
D287,795 S 1/1987 Streepy
4,685,311 A 8/1987 Rastelli
4,765,440 A * 8/1988 Tashman ..... A47F 10/06 186/44
4,986,616 A * 1/1991 Chang ..... A47B 21/0314 108/138
5,031,602 A * 7/1991 Vick ..... A47J 37/0713 126/1 AA
5,168,719 A 12/1992 Branz et al.
5,188,089 A * 2/1993 Hamilton ..... A47J 37/0786 108/134
5,191,769 A 3/1993 Mangini et al.
5,282,367 A 2/1994 Moore et al.
6,109,051 A 8/2000 Majordy
6,151,905 A 11/2000 Smith
6,385,990 B1 5/2002 Lee
6,612,124 B1 9/2003 Hatch et al.
6,776,084 B2 * 8/2004 Wild ..... A47J 37/0704 126/25 R
6,941,765 B2 9/2005 Sung
D512,246 S 12/2005 Welch et al.
7,219,608 B2 5/2007 Sung
7,243,506 B2 7/2007 Spillner
D570,640 S * 6/2008 Brunner ..... D7/332
7,703,450 B2 * 4/2010 Brunner ..... A47J 37/0713 126/25 A
7,703,453 B2 * 4/2010 Hughes ..... F24C 15/16 123/332
7,832,390 B2 * 11/2010 Hsu ..... F24C 1/02 126/25 R
7,905,225 B2 * 3/2011 Contarino ..... A47J 37/074 126/25 R
8,127,757 B1 * 3/2012 Bourgeois ..... A47J 37/0704 126/25 A
8,733,253 B1 5/2014 Norman et al.
9,635,936 B1 * 5/2017 Swislow ..... A47B 31/00
2002/0148794 A1 * 10/2002 Marihugh ..... A47F 1/126 211/59.3
2009/0283091 A1 * 11/2009 Deng ..... F24C 15/107 126/41 R

OTHER PUBLICATIONS

Coreco, S.A., 2012 Catalog, retrieved from Internet in 2016, (See pp. 5 & 6), http://www/ciaireland.ie/wp-content/uploads/Coreco.

* cited by examiner

FOOD PREPARATION TABLE

TECHNICAL FIELD

This application relates generally to food preparation tables and, more specifically, to a modular grate/catch pan assembly for use on food preparation tables.

BACKGROUND

Food preparation tables are commonly used in commercial establishments for preparing food products that incorporate multiple ingredients. A typical food preparation table includes a frame and housing structure having an internal refrigeration or other cooling system. An upper surface of the housing includes a front preparation surface that is cooled and a rear food storage arrangement that may include multiple individual pans for holding multiple individual food items that can be used in the preparation of food products. The pans are also cooled in order to keep the food items fresh.

Food item catchment systems have been used in the past to catch food items dropped over the front preparation surface. Such catchment systems have typically included a fixed frame atop the food preparation surface that can hold grate structures and includes one or more forward facing slots that allow food pans to be moved into and out of the space below the grate structures. Fixed frame catchment systems, however, are not conducive to table manufacture or cleanability.

It would be desirable to provide a food preparation table that includes a grate and catch pan arrangement that is more convenient to manufacture, more convenient to use and/or more convenient to clean.

SUMMARY

In one aspect, a food preparation table includes a housing including a food item holding and cooling arrangement and a food preparation area. The food preparation area includes an upwardly facing surface that is cooled from its underside, and a modular grate and catch pan arrangement atop the upwardly facing surface. The modular grate and catch pan arrangement includes a plurality of modular frame units positioned side-by-side along the upwardly facing surface and removably retained in place by one or more of retaining pins protruding upward from the upwardly facing surface and/or engagement with a lip structure formed at a rear of the upwardly facing surface, each modular frame unit including an upper grate receiving perimeter, and a forward facing pan slot. A plurality of grate units are positioned atop a respective modular frame unit and removably retained in place by at least one projection from the frame unit that interacts with the grate unit. A plurality of pan units are positioned below a respective one of the grate units and removable through a respective one of the pan slots.

In another aspect, a food preparation table includes a food item catchment system comprising a modular grate and catch pan arrangement positioned atop an upwardly facing surface of the table and including multiple catch pans, multiple frames and multiple grates, each of which is removable for cleaning of the upwardly facing surface and for cleaning of the catch pans, frames and grates.

In yet another aspect, a food preparation table includes a housing including an upper portion with a rearward food item holding and cooling arrangement and a forward food preparation area. The forward food preparation area includes an upwardly facing surface, and a modular grate and catch pan arrangement atop the upwardly facing surface. The modular grate and catch pan arrangement includes a plurality of removable frame units positioned side-by-side along the upwardly facing surface, each frame unit removably retained in place by at least one upwardly facing lip that is positioned behind a downwardly facing lip of the housing.

The details of one or more embodiments are set forth in the accompanying drawings and the description below. Other features, objects, and advantages will be apparent from the description and drawings, and from the claims.

DETAILED DESCRIPTION

Figure 1:
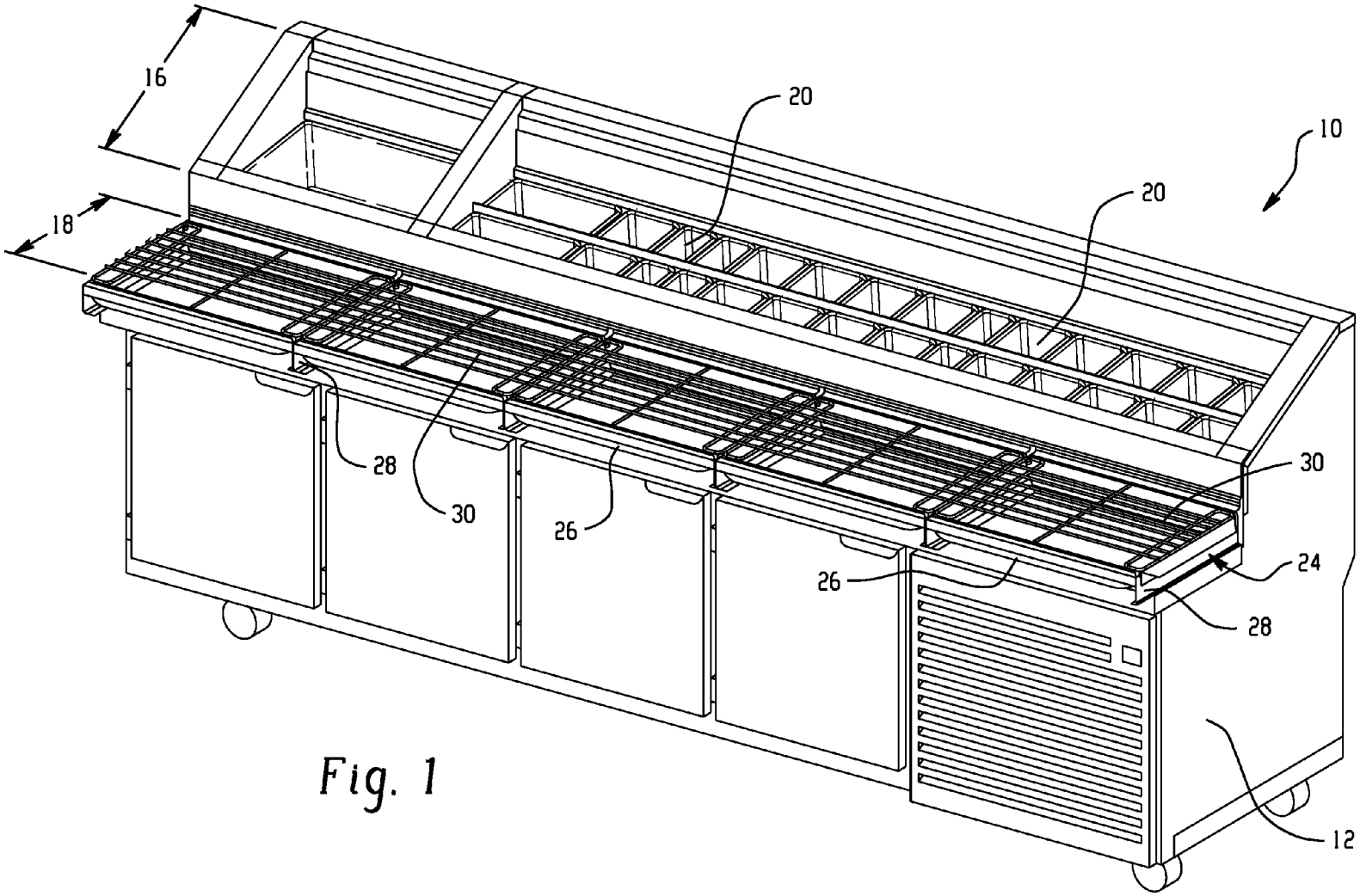
FIG. 1 is a perspective view of one embodiment of a food preparation table.
Figure 2:
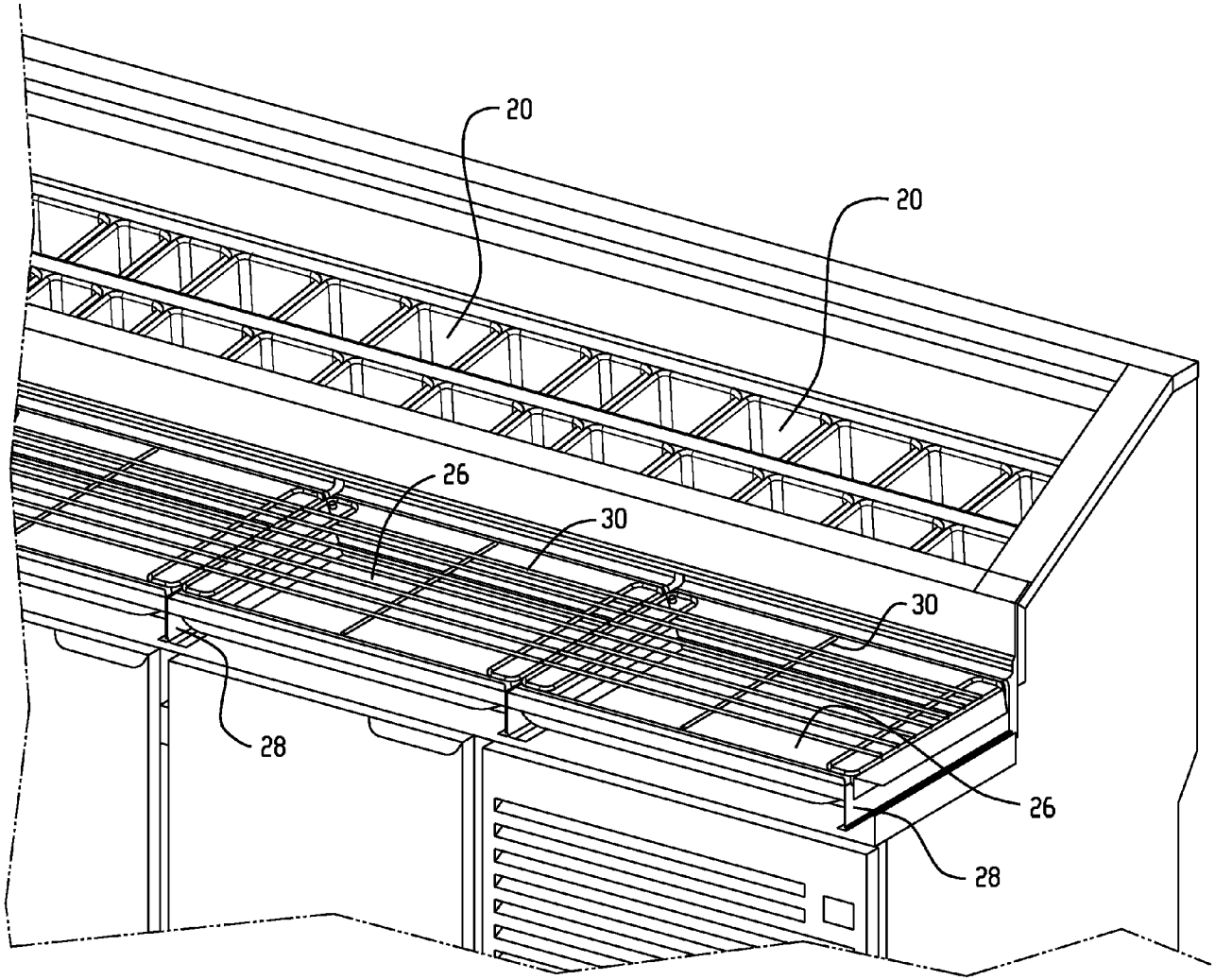
FIG. 2 is a partial perspective view of the table of FIG. 1.

Referring to FIGS. 1-9, a food preparation table 10 includes a housing 12 formed with a food item holding and cooling arrangement 16 and a food preparation area 18. The food item holding and cooling arrangement 16 may be in a rearward and/or raised portion of the housing and include multiple individual food holding pans 20 that are mounted within a rail system that is cooled by one or more of cooling fluid flows in the rails and/or cool air flows over the pans. Glycol bath type cooling of the pans could also be used. The table 10 may include an on-board refrigeration or other cooling system for this purpose, or may be connectable to a remote system. The table may, by way of example, be used for the production of sub sandwiches, pizzas or other food items that selectively utilize multiple possible ingredients that can be held in the pans 20.

Figure 8A:
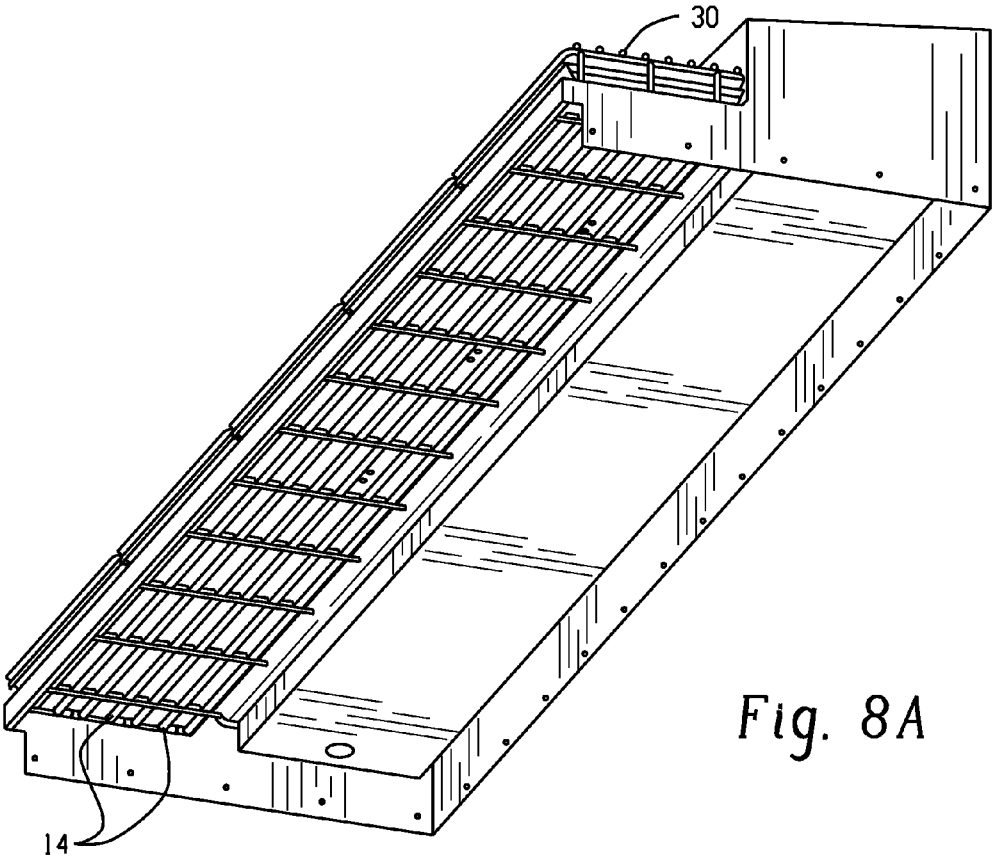
FIG. 8A shows a perspective underside view of a tubing system for cooling an upwardly facing food preparation surface of the table.
Figure 8B:
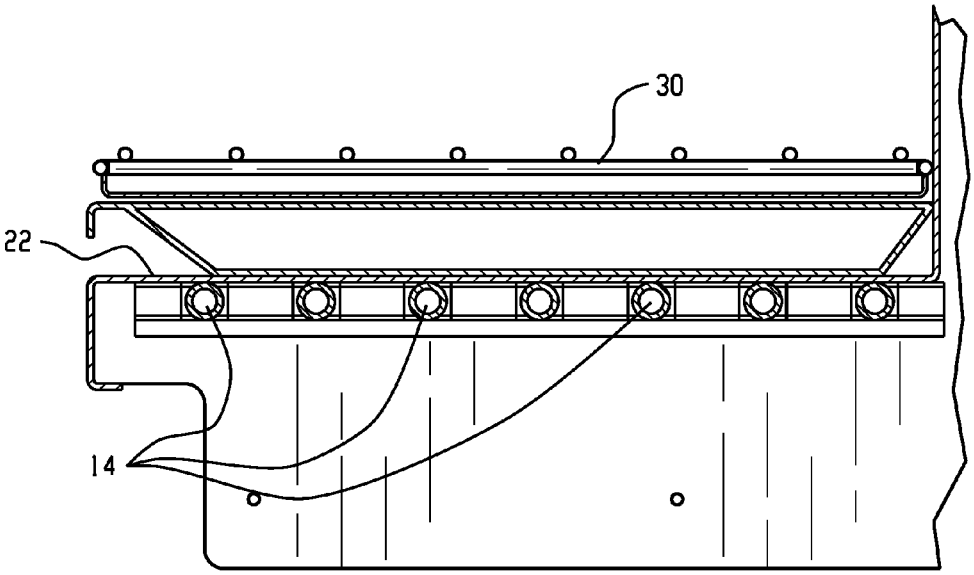
FIG. 8B shows a side, cross-sectional view through the upwardly facing food preparation surface.
Figure 9:
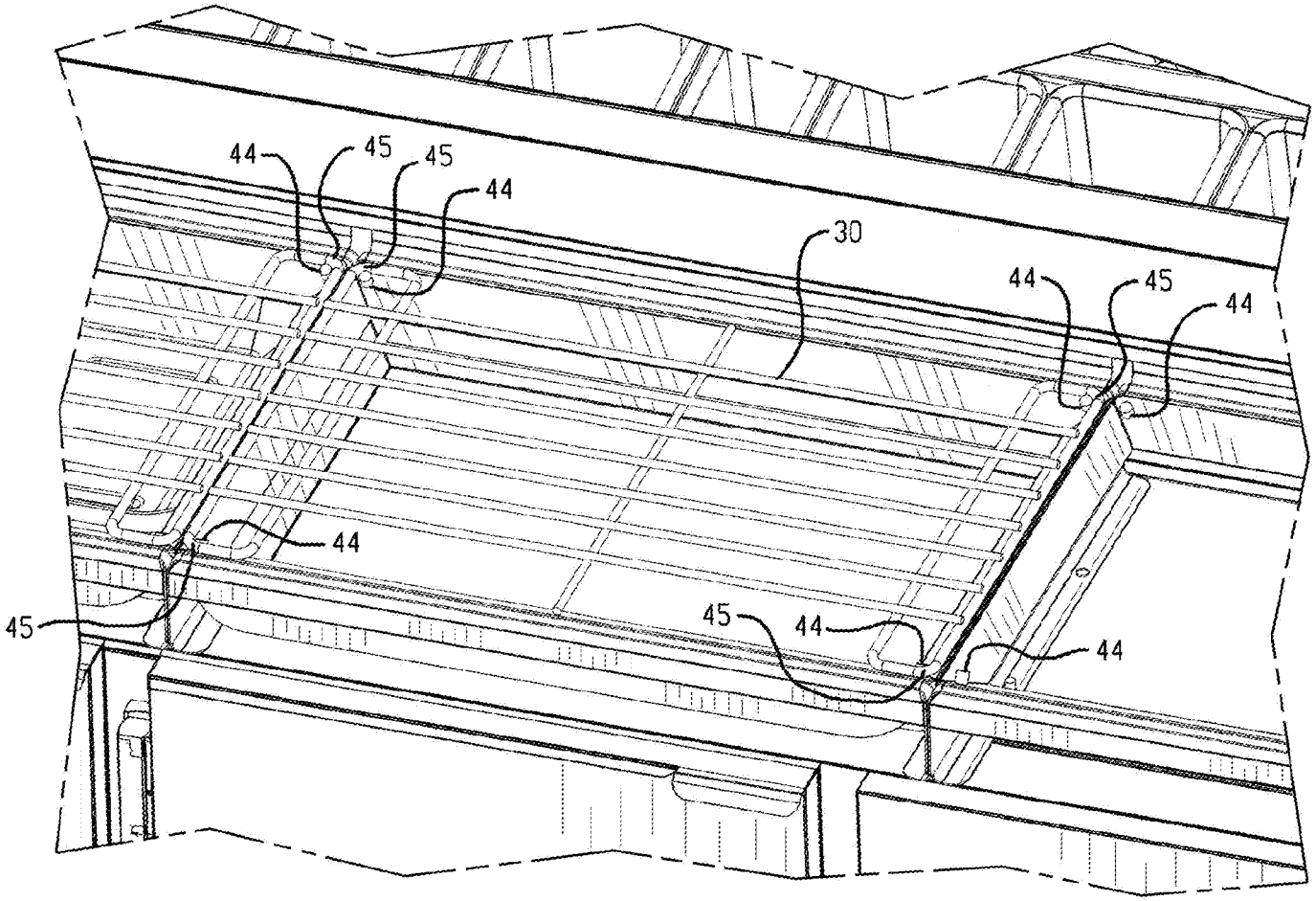
FIG. 9 shows grate engagement to pins on the frame units.

The food preparation area includes an upwardly facing surface 22 that may be cooled from its underside. Referring to FIGS. 8A and 8B, the surface 22 may be cooled by one or more tubes 14 connected in series in the hollow underside of the table directly below the surface 22 and through which a cold media, such as glycol or a refrigerant, flows. The surface may also be cooled by other means, such as a cooling air flow directly below the surface. The surface 22, like a majority of the housing, may be formed from any suitable material, such as stainless steel.

A modular grate and catch pan arrangement 24 is located atop the upwardly facing surface 22 and includes multiple catch pans 26, multiple frame units 28 and multiple grates 30. The length of each frame unit 28, catch pan 26 and grate 30, is shorter than the overall length of the table 10. In the embodiment illustrated in FIG. 1 five modular frame units 28, five catch pans 26 and five grates 30 are distributed across the width of the preparation table, but the number could vary according to size of the preparation table and/or exact size of each modular frame unit 28. Preferably, the pans, frames and grates may all be suitably sized to enable cleaning within a sink or dishwasher. Notably, the grates 30 sit atop the frames 28, and the pans 26 are located below the grates to catch any food items that drop during a food preparation process. The pans 26, frames 28 and grates 30 are all separately removable for cleaning of the upwardly facing surface 22 and for cleaning of the catch pans, frames and grates. In particular, the modular frame units 28 are not directly connected to any adjacent modular frame unit 28 so that each unit can be independently removed from the food preparation area 18 without the need to separate frame units from one another or remove additional frame units. However, removable diversion plates 55 may sit over the adjacent side portions of adjacent grate units and are configured to assure that food items are directed toward the pans. Diversion plates 55*a* at the ends of the table width may have a slightly different configuration as shown.

Figure 3:
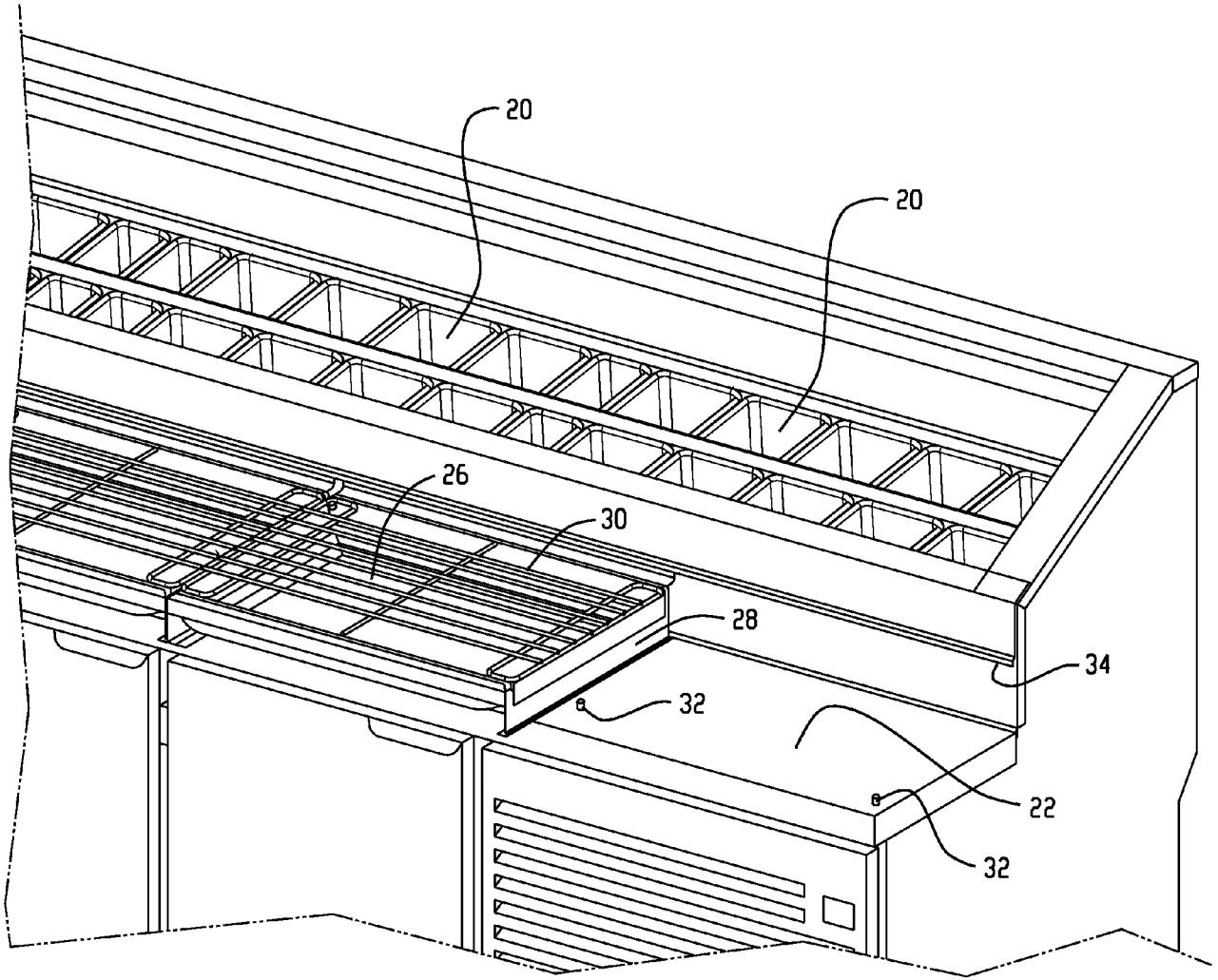
FIG. 3 shows one modular frame unit removed from the table.
Figure 4:
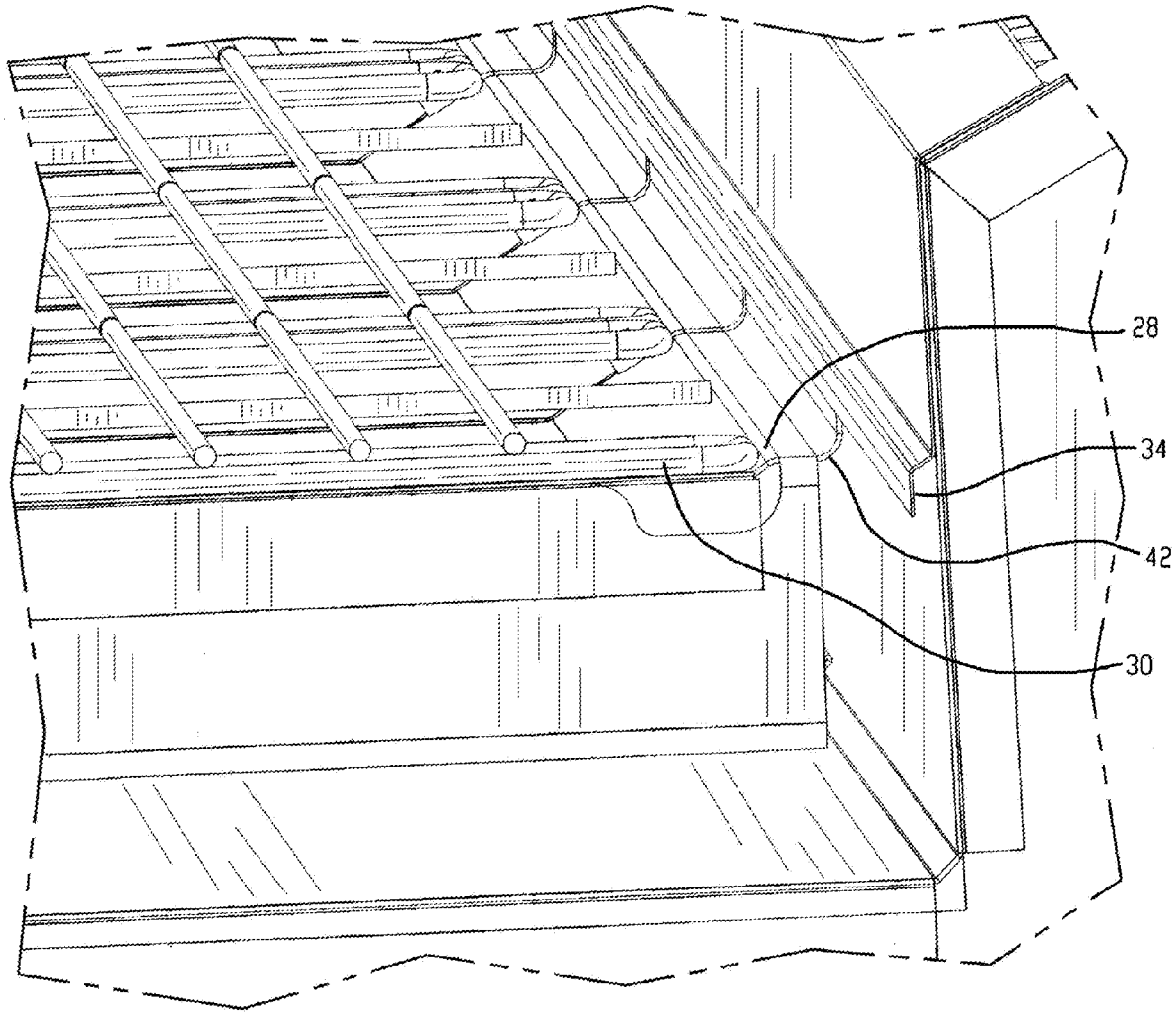
FIG. 4 shows an engaging lip arrangement.
Figure 5:
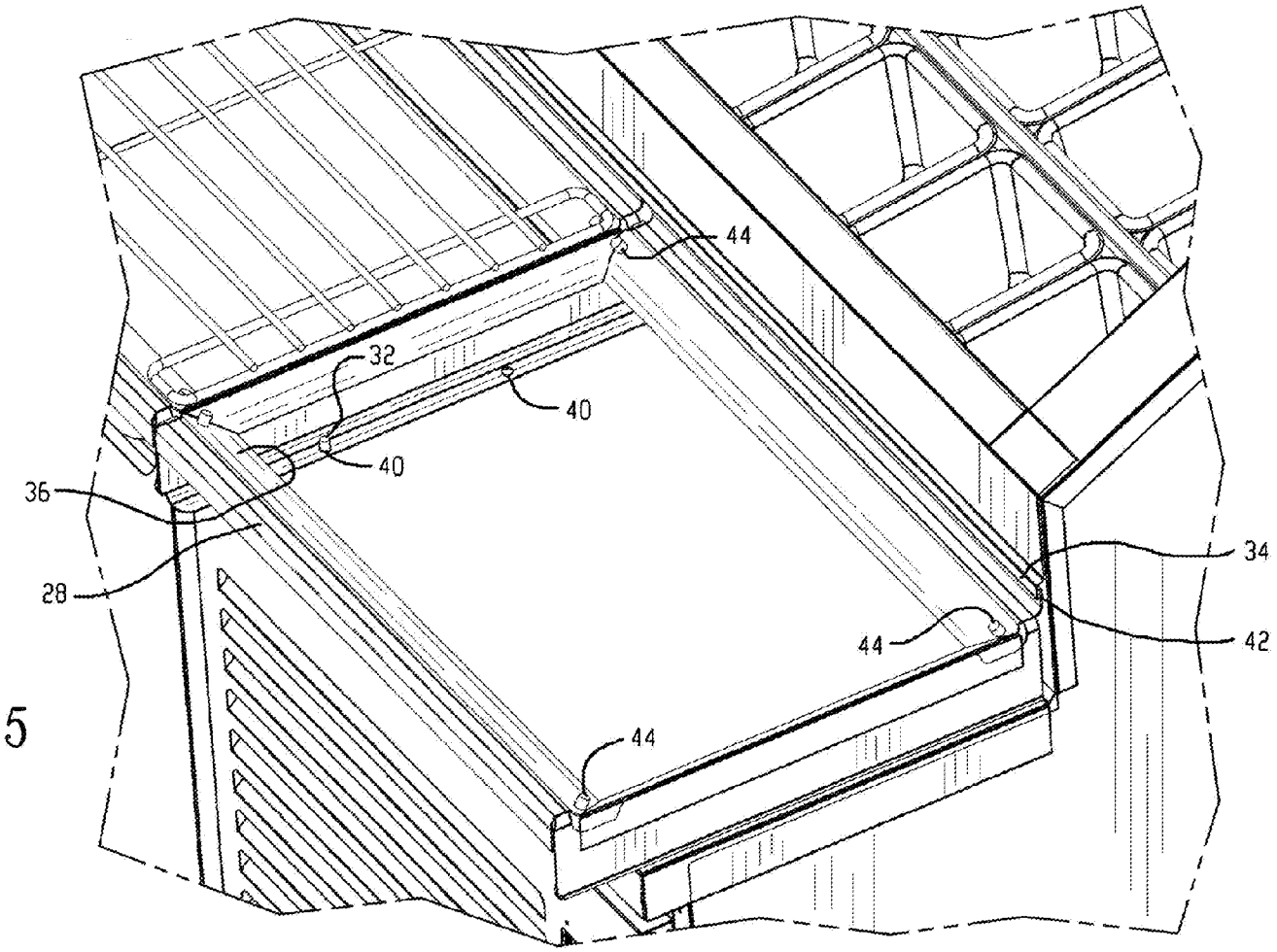
FIG. 5 shows the positioning of a frame unit atop the table.
Figure 6:
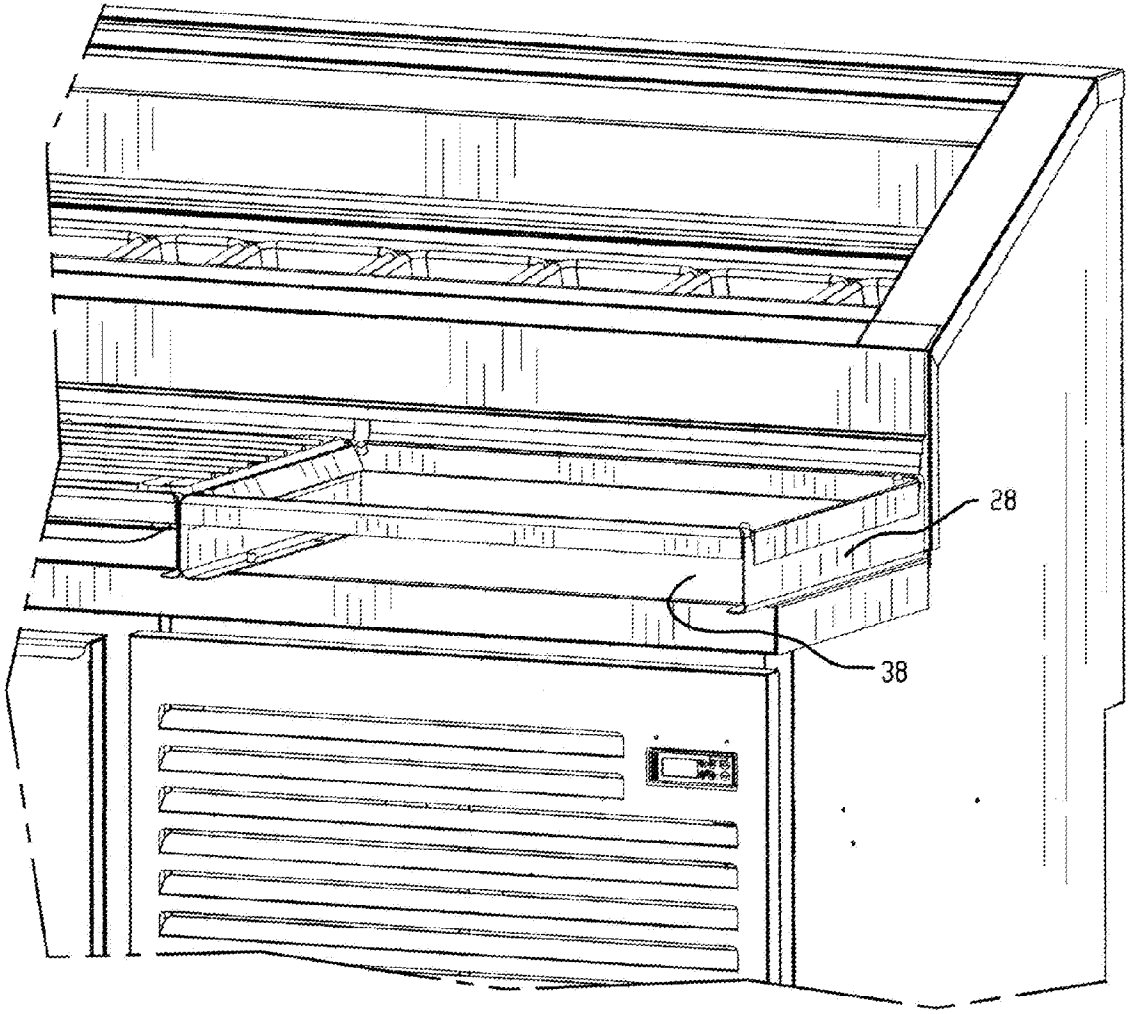
FIG. 6 shows the front pan slot of the frame unit of FIG. 5.
Figure 7A:
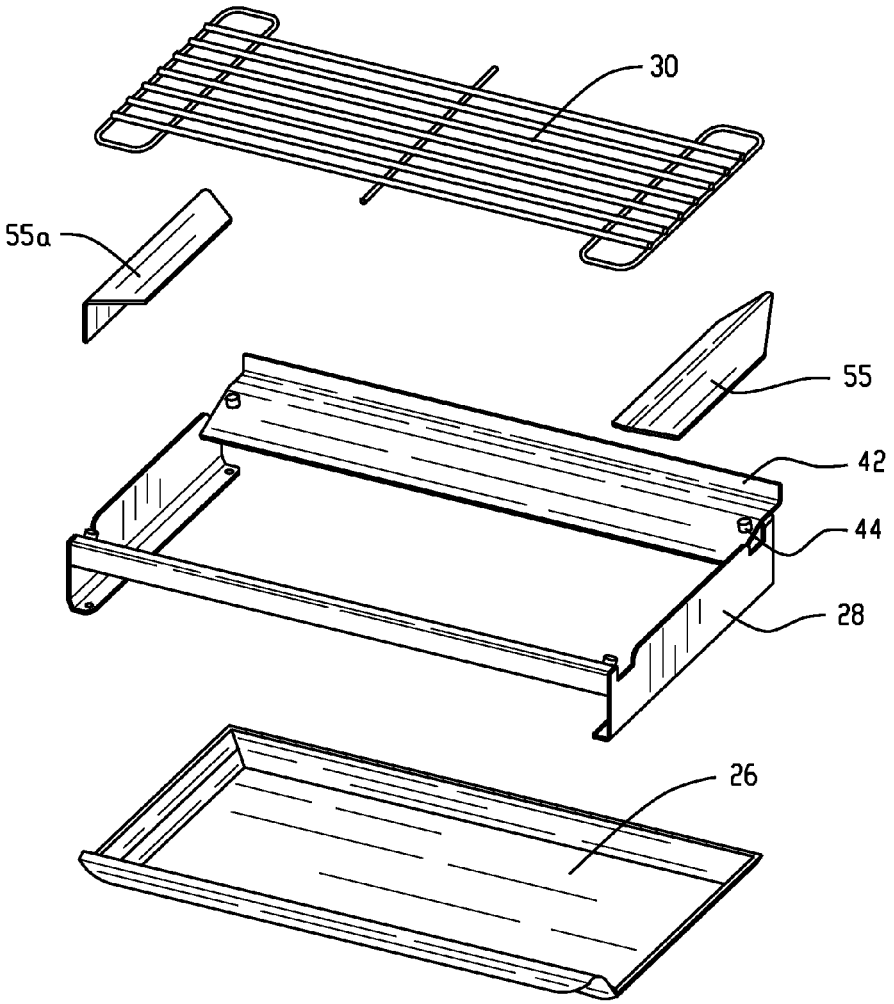
FIG. 7A shows a modular grate and catch pan assembly exploded.
Figure 7B:
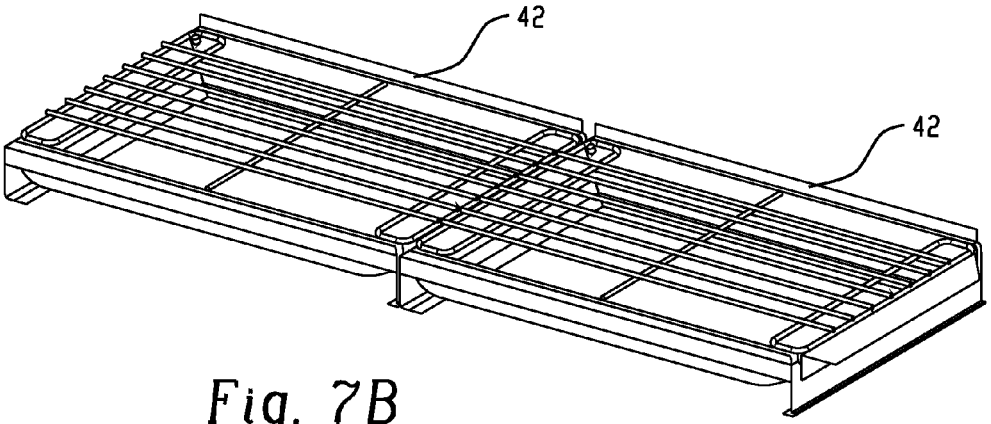
FIG. 7B shows a set of side-by-side modular grate and catch pan assemblies.

The modular frame units 28 are positioned side-by-side along the upwardly facing surface 22 and are removably retained in place so as to provide stability during use. In particular, the frame units 28 are restrained from lateral movement along the upwardly facing surface 22 but can still be lifted or pivoted off of the surface 22, without the use of tools, for removal and cleaning. With reference to FIG. 3, which shows one modular frame unit having been removed from the surface 22, each frame unit 28 may engage with retaining pins 32 protruding upward from the upwardly facing surface 22 and/or may engage with a lip structure 34 formed at a rear side of the upwardly facing surface 22. As best seen in FIG. 5, each frame unit includes one or more openings 40 in its base that aligns with and fits over a pin 32 in a cooperative retaining arrangement. Likewise, each frame unit 28 includes a rearward lip structure 42 that is configured to interact with the lip structure 34 on the table housing. In particular, the frame unit lip structure 42 extends upward and is positionable behind the downward extending lip structure 34. To position a frame unit in place on the table, the frame unit is laterally aligned to a desired position, pivoted up (rear down, front up) so that the frame lip structure 42 can move behind the lip structure 34, and then pivoted back down so that the pin(s) 32 pass through the base opening(s) 40.

Each modular frame unit 28 is configured to form an upper grate receiving perimeter 36 and to form a forward facing pan slot 38 when mounted atop the surface 22. Each grate unit 30 is positioned atop a respective modular frame unit and removably retained in place. By way of example, the upper perimeter of the frame units may be formed with one or more projections/pins 44 (e.g., in the corners) that interact with the grate unit 30 to aid in holding the grate unit in place. In particular, the wire/bar material of the grate units includes corner bends 45 positioned to sit adjacent respective ones of the pins 44 for this purpose. As is most visible in FIG. 4, the outer perimeter of the grate unit 30 is slightly recessed into the upper portion of the frame unit 28, which also provides a retention and stability feature for the grates. The grate units can, however, be lifted off of the frame units for cleaning. The pins 45 may also restrict deflector movement after installation. As mentioned above, the deflectors 55 are installed over the sides of modular boxes/frame units covering the gap between them and are supported by the front and rear sloped flanges of the modular box/frame unit.

As previously noted, each pan 26 is positioned below a respective one of the grate units 30 and removable through the corresponding pan slot 38 formed by a frame unit 28. Each pan unit 26 may be of metal construction and includes a generally planar bottom surface that may lie in thermal contact with the upwardly facing surface 22 to aid in cooling the pan so that food items that fall into the pan unit through the grate unit remain fresh. Each frame unit 28 may be commonly shaped and sized, each grate unit 30 may be commonly shaped and sized and each pan 26 may be commonly shaped and sized to permit modular positioning and interchangeability along a length of the upwardly facing surface. Thus, when the various components are removed for cleaning, replacement does not require each component to be returned to its original position.

It is to be clearly understood that the above description is intended by way of illustration and example only, is not intended to be taken by way of limitation, and that other changes and modifications are possible.

What is claimed is:

1. A food preparation table, comprising:

a housing including a food item holding arrangement and a food preparation area, the food preparation area comprising:

an upwardly facing surface;

a modular grate and catch pan arrangement atop the upwardly facing surface and including multiple catch pans, multiple frame units and multiple grates, each of which is removable for cleaning of the upwardly facing surface and for cleaning of the catch pans, frame units and grates;

wherein the multiple frame units are positioned side-by-side along the food preparation area and each frame unit of the multiple frame units is not directly connected to any other frame unit of the multiple frame units so that each frame unit can be independently removed from the food preparation table;

wherein at least one frame unit of the multiple frame units is removably retained on the upwardly facing surface by an upwardly projecting pin that restrains the frame unit from lateral movement along the upwardly facing surface but allows the frame unit to be lifted off of the upwardly facing surface.

2. The food preparation table of claim 1 wherein at least one frame unit of the multiple frame units includes spaced apart projecting pins that interact with respective corner bends of a respective grate of the multiple grates that is seated on the at least one frame unit.

3. The food preparation table of claim 2 wherein the outer perimeter of the respective grate that is seated on the at least one frame unit is slightly recessed into an upper portion of the at least one frame unit to provide additional retention and stability for the respective grate that is seated on the at least one frame unit.

4. The food preparation table of claim 1 wherein the food item holding arrangement is raised relative to the food preparation area and positioned rearward of the food preparation area, a retaining lip structure located at a front side of the food item holding arrangement extends downward toward the upwardly facing surface, and at least one frame unit of the multiple frame units includes an upwardly extending lip structure that sits behind the retaining lip structure.

5. A food preparation table, comprising:

a housing including a food item holding and cooling arrangement and a food preparation area, the food preparation area comprising:

an upwardly facing surface;

a modular grate and catch pan arrangement atop the upwardly facing surface and including;

a plurality of modular frame units positioned side-by-side along the upwardly facing surface, each modular frame unit is removably retained in place by at least one retaining pin protruding upward from the upwardly facing surface and by engagement with a lip structure on the housing that extends downward toward the upwardly facing surface, each modular frame unit including an upper grate receiving perimeter, and a forward facing pan slot, wherein the at least one retaining pin is located forward of the lip structure on the housing;

a plurality of grate units, each grate unit positioned atop a respective one of the modular frame units and removably retained in place by at least one projection from the respective one of the modular frame units that interacts with the grate unit;

a plurality of pan units, each pan positioned below a respective one of the grate units and removable through a respective one of the pan slots.

6. The food preparation table of claim 5 wherein each pan unit is of metal construction and includes a generally planar bottom surface that lies in thermal contact with the upwardly facing surface.

7. The food preparation table of claim 5 wherein each pan unit, each frame unit and each grate unit is sized to permit cleaning within a sink.

8. The food preparation table of claim 5 wherein each frame unit is independently removable from the upwardly facing surface without using tools.

9. A food preparation table, comprising:

a housing including an upper portion with a rearward food item holding and cooling arrangement and a forward food preparation area, the forward food preparation area comprising:

an upwardly facing surface;

a modular grate and catch pan arrangement atop the upwardly facing surface and including:

a plurality of removable frame units positioned side-by-side along the upwardly facing surface, each frame unit having a base portion supported in contact with the upwardly facing surface, each frame unit removably retained in place by at least one upwardly facing lip, at a rear side of the frame unit, that is positioned behind a downwardly facing lip of the housing, each frame unit including an upper grate receiving perimeter and a forward facing pan slot, wherein each frame unit is removable by pivoting a front side of the frame unit up and the rear side of the frame unit down so that the upwardly facing lip moves below the downwardly facing lip of the housing.

10. The food preparation table of claim 9 wherein each frame unit further includes at least one opening in the base portion of the frame unit, where a pin projecting upwardly from the upwardly facing surface at a location forward of the downwardly facing lip is disposed through the opening.

11. The food preparation table of claim 10 wherein each frame unit is removable without the use of tools.

12. The food preparation table for claim 9 wherein each frame unit is independently removable from the upwardly facing surface of the table.

* * * * *